US011083221B2

(12) United States Patent
Tong

(10) Patent No.: US 11,083,221 B2
(45) Date of Patent: Aug. 10, 2021

(54) LIQUID SUPPLY FOR ELECTRONIC SMOKING DEVICE

(71) Applicant: FONTEM HOLDINGS 1 B.V., Amsterdam (NL)

(72) Inventor: Xinliang Tong, Beijing (CN)

( * ) Notice: Subject to any disclaimer, the term of this patent is extended or adjusted under 35 U.S.C. 154(b) by 335 days.

(21) Appl. No.: 15/752,225

(22) PCT Filed: Aug. 25, 2015

(86) PCT No.: PCT/CN2015/087980

§ 371 (c)(1),
(2) Date: Feb. 12, 2018

(87) PCT Pub. No.: WO2017/031678

PCT Pub. Date: Mar. 2, 2017

(65) Prior Publication Data

US 2020/0146350 A1 May 14, 2020

(51) Int. Cl.
*A24F 40/40* (2020.01)
*A24F 40/44* (2020.01)
(Continued)

(52) U.S. Cl.
CPC ..... *A24F 40/40* (2020.01); *A24F 40/42* (2020.01); *A24F 40/44* (2020.01); *A24F 40/485* (2020.01); *A24F 40/10* (2020.01)

(58) Field of Classification Search
CPC ..... A24F 40/42; A24F 40/44; A24F 40/10; A24F 40/00; A24F 47/00–008;
(Continued)

(56) References Cited

U.S. PATENT DOCUMENTS 4,765,347 A * 8/1988 Sensabaugh, Jr. .... A24F 47/002 131/173
2006/0191546 A1* 8/2006 Takano ..... A24F 47/002 131/270

(Continued)

FOREIGN PATENT DOCUMENTS

CN 87103178 A 11/1987
CN 203646499 U 6/2014

(Continued)

OTHER PUBLICATIONS

European Patent Office, Extended European Search Report for European Application No. EP15901949.6, dated Aug. 3, 2018, 10 pages.

(Continued)

*Primary Examiner* — Michael H. Wilson
*Assistant Examiner* — Yana B Krinker
(74) *Attorney, Agent, or Firm* — Perkins Coie LLP; Kenneth H. Ohriner

(57) ABSTRACT

A liquid supply for electronic smoking device has a compartment (102) within a housing (100). A reservoir (200) is provided in the compartment (102) for storing liquid, with at least one portion the reservoir (200) attached to the housing (100). The reservoir (100) contracts as liquid flows out of the reservoir (200). The reservoir (200) does not collapse or fold as it contracts, to avoid interfering with outflow of liquid. The reservoir (200) may comprise an elastomeric material, such as rubber. The reservoir (200) may be pretensioned or elastically stretched when filled with liquid. The reservoir (200) then exerts an elastic compression force on the liquid in the reservoir (200).

16 Claims, 7 Drawing Sheets

(51) Int. Cl.
*A24F 40/42* (2020.01)
*A24F 40/485* (2020.01)
*A24F 40/10* (2020.01)

(58) Field of Classification Search
CPC ..... A24F 40/40; A24F 40/485; A61M 15/06; A61M 15/009; A61M 15/0091; A61M 2202/0468
USPC ..... 131/270, 273, 194, 329; 128/202.21
See application file for complete search history.

(56) References Cited

U.S. PATENT DOCUMENTS

| | | | | |
|---|---|---|---|---|
| 2013/0213418 | A1* | 8/2013 | Tucker | A24F 47/008 131/328 |
| 2013/0228191 | A1 | 9/2013 | Newton | |
| 2014/0190496 | A1 | 7/2014 | Wensley et al. | |
| 2014/0202472 | A1* | 7/2014 | Levitz | A24F 13/00 131/187 |
| 2014/0261499 | A1 | 9/2014 | Hon et al. | |
| 2015/0027456 | A1 | 1/2015 | Pithawalla et al. | |
| 2015/0216237 | A1 | 8/2015 | Wensley et al. | |

FOREIGN PATENT DOCUMENTS

| | | | |
|---|---|---|---|
| CN | 204070556 | U | 1/2015 |
| CN | 104351949 | A | 2/2015 |
| CN | 104544565 | A | 4/2015 |
| EP | 0244684 | A2 | 11/1987 |
| WO | 2015086318 | A1 | 6/2015 |

OTHER PUBLICATIONS

Machine Translation of CN104544565 obtained from Espacenet Jan. 24, 2020, 8 pages.
State Intellectual Property Office Office Action in Chinese Application No. 201580038110.1; dated Nov. 5, 2019; with English summary; 11 pages.
State Intellectual Property Office, Second Office Action in Chinese Application No. 201580083110.1, dated May 12, 2020, with English summary, 9 pages.
State Intellectual Property Office, China PRC, "International Search Report and Written Opinion", for PCT Application No. PCT/CN2015/087980, dated May 24, 2016, 15 pgs.
Chinese Final Rejection for Appln. No. 201580083110.1 dated Apr. 1, 2021, 3 pages.

* cited by examiner

LIQUID SUPPLY FOR ELECTRONIC SMOKING DEVICE

BACKGROUND

Many electronic smoking or vaporizing devices have a rigid cartridge housing for storing liquid. The rigid cartridge housing has an outlet port for supplying liquid to an atomizer, and an air vent or inlet to allow air to flow into the cartridge housing. Air in the cartridge housing may mix with the liquid in the cartridge housing creating a gas phase. The gas phase can expand if ambient temperature increases, creating positive pressure in the cartridge housing, which may cause liquid to leak out of the cartridge housing. The gas phase in the cartridge housing may also form bubbles in the liquid which may interfere with flow of liquid to the atomizer. Accordingly, improved designs are needed.

BRIEF STATEMENT OF THE INVENTION

A liquid supply for an electronic smoking or vaporizing device has a housing. A reservoir is provided within the housing with at least part of the reservoir attached to the housing. The reservoir compensates for pressure changes and remains in position within the housing even as the volume of the reservoir decreases as liquid flows out of the reservoir. As the reservoir does not fold or collapse, liquid can continue to flow out of the reservoir freely, until the reservoir is empty. The liquid supply may include a liquid conducting component engaging an outlet port to transport liquid out of the reservoir and to seal the outlet port from leaking.

OVERVIEW OF THE INVENTION

Figures 1A, 1B, 1C, 1D:
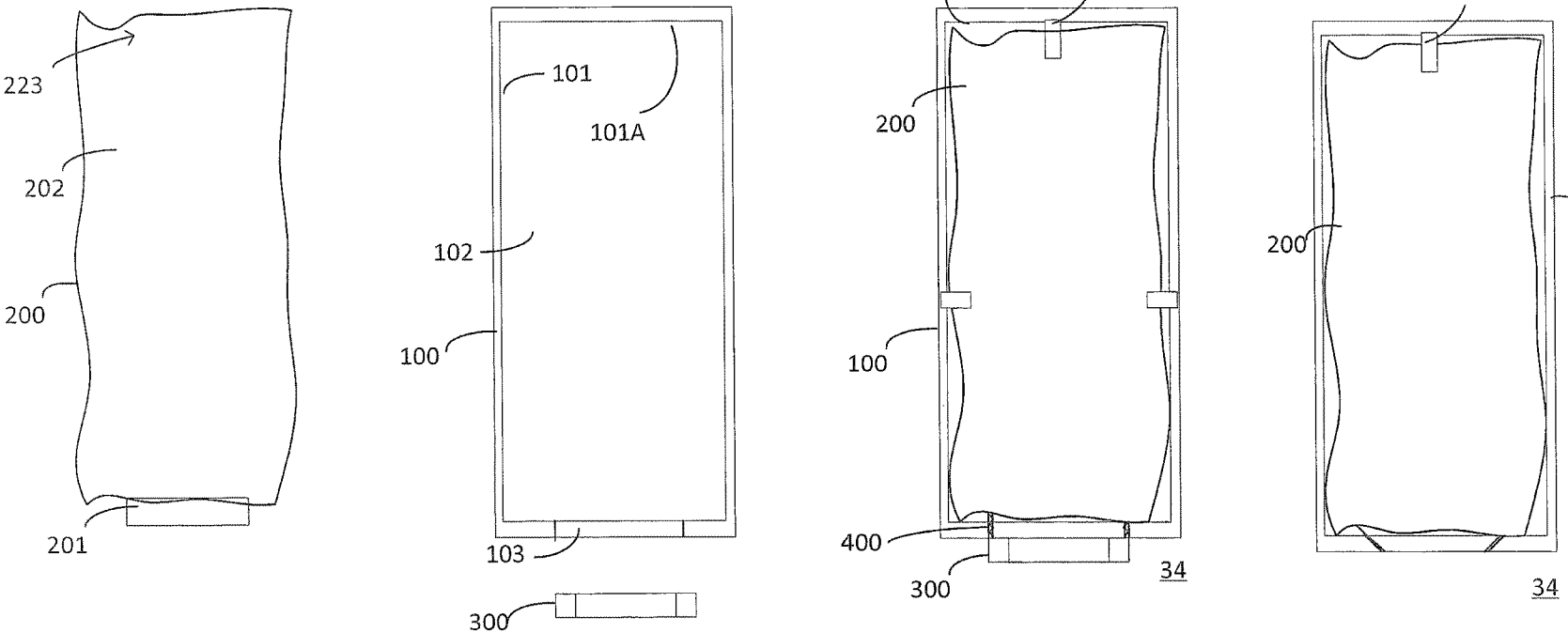
FIG. 1A is a side view of a first embodiment of a liquid reservoir.
FIG. 1B is a side view of a housing for the reservoir shown in FIG. 1A.
FIG. 1C is a section view of the reservoir of FIG. 1A assembled into the housing of FIG. 1B to form a liquid supply.
FIG. 1D is a side view of a second embodiment.

The reservoir, which may be provided as bottle, balloon or a bladder having an internal volume that adapts to the outflow of the liquid. The reservoir may be referred as a soft reservoir, although the reservoir material may or may not be soft and/or flexible. For example, a reservoir can be made from elastomeric material such as natural and synthetic rubber, or from non-elastomeric material such as plastic polymers including polyvinyl chloride and polypropylene.

The reservoir can be fully filled with liquid, with little or no gas in the reservoir, and with no air inlet or vent. As liquid from the reservoir is consumed, the reservoir contracts. No vacuum is formed within the reservoir, and no air enters into the reservoir. Without gas in the reservoir, leakage of the reservoir due to thermal expansion of gas, and generation of bubbles in the liquid, can be avoided.

The reservoir can be pre-tensioned or elastically stretched when filled with liquid. The pre-tension is gradually released with the outflow of the liquid and in turn the reservoir is allowed to contract. Pre-tension can be applied to the reservoir by regulating pressure in the compartment. Alternatively, pretension can be applied to the reservoir by stretching an elastomeric material reservoir.

The reservoir has an outlet port to allow the liquid to flow out of the reservoir. The outlet port may be anchored to the housing of the liquid supply. The housing of the liquid supply can have a tapering or conical opening, with the outlet port of the reservoir constrained within the opening. The reservoir may have a rigid bottom that fits into the housing, to restrict the longitudinal movement of the reservoir, particularly longitudinal movement towards the outlet port. The reservoir may include a wick having two ends, with one end of the wick extending into the reservoir and the other end fixedly attached to the outlet port. The wick may extend from the opening of the reservoir towards the bottom of the reservoir, with the wick optionally bonded to the reservoir. The liquid conducting component can be a gasket or pad that is in fluid communication with the wick.

The housing can be integral one-piece member or a two-piece design. For example, the housing can have a first piece and a second piece detachably connected to the first piece, with the opening positioned in the first piece and at least the bottom of the reservoir anchored to the second piece. The volume of the first piece may be greater than the volume of the second piece. With the reservoir anchored to the housing, contraction of the width (or thickness) of reservoir is greater than both the contraction of the reservoir in the lateral and longitudinal directions.

A valve may be positioned between the opening of the housing and the outlet port of the reservoir. The housing can have an air inlet that introduces air into the space formed between the reservoir and the housing. The valve can be between the chamber and an air passageway connecting to the inlet of the electronic cigarette. The valve is opened by the sub-atmospheric pressure generated within the air passageway by a puff action of a user, and the valve is closed when the puff action ends. The air flow into the space during the puff action may regulate the pressure applied on the reservoir. This design can be especially useful when the reservoir is made from non-elastomeric material, that is, the pressure applied on the reservoir can regulate the speed of the outflow of liquid from the reservoir.

DETAILED DESCRIPTION OF THE DRAWINGS

Figure 8:
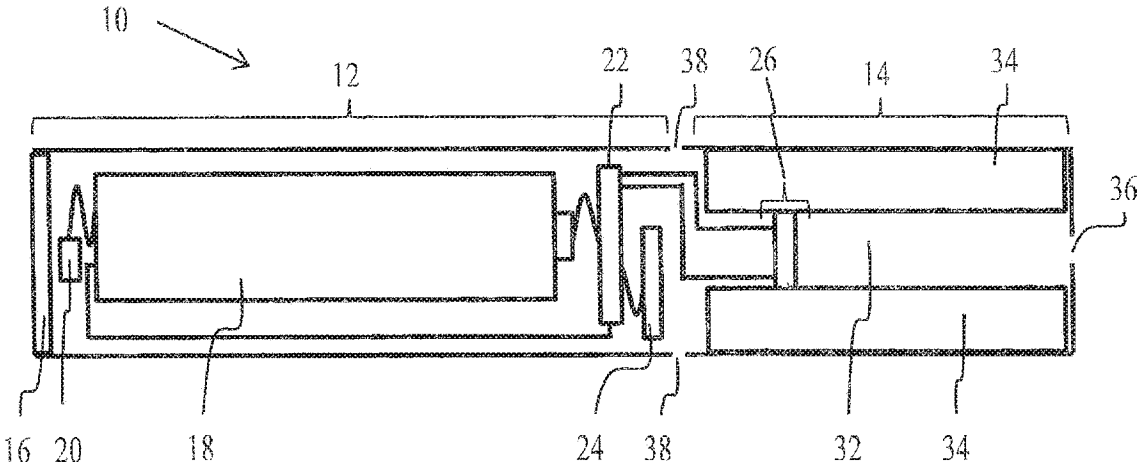
FIG. 8 is a diagram of an electronic cigarette.

As is shown in FIG. 8, an e-cigarette 10 typically has a housing comprising a cylindrical hollow tube having an end cap 16. The cylindrical hollow tube may be single piece or a multiple piece tube. In FIG. 8, the cylindrical hollow tube is shown as a two piece structure having a battery section 12 and an atomizer/liquid supply section 14. Together the battery section 12 and the atomizer/liquid supply section 14 form a cylindrical tube which is approximately the same size and shape as a conventional cigarette, typically about 100 mm with a 7.5 mm diameter, although lengths may range from 70 to 150 or 180 mm, and diameters from 5 to 20 mm.

The battery section 12 and atomizer/liquid supply section 14 are typically made of steel or hardwearing plastic and act together with the end caps to provide a housing to contain the components of the e-cigarette 10. The battery section 12 and a atomizer/liquid supply section 14 may be configured to fit together by a friction push fit, a snap fit, or a bayonet attachment, magnetic fit, or screw threads. The end cap 16 is provided at the front end of the main body 12. The end cap 16 may be made from translucent plastic or other translucent material to allow an LED 20 positioned near the end cap to emit light through the end cap. The end cap can be made of metal or other materials that do not allow light to pass.

An air inlet 38 may be provided in the end cap, at the edge of the the cylindrical hollow tube, anywhere along the length of the cylindrical hollow tube, or at the connection of the battery section 12 and the atomizer/liquid supply section 14. FIG. 8 shows a pair of air inlets 38 provided at the intersection between the battery section 12 and the atomizer/liquid supply section 14.

A battery 18, a light emitting diode (LED) 20, control electronics 22 and optionally an airflow sensor 24 are provided within the cylindrical hollow tube battery section 12. The battery 18 is electrically connected to the control electronics 22, which is electrically connected to the LED 20 and the airflow sensor 24. In this example the LED 20 is at the front end of the main body 12, adjacent to the end cap 16 and the control electronics 22 and airflow sensor 24 are provided in the central cavity at the other end of the battery 18 adjacent the atomizer/liquid supply section 14.

The airflow sensor 24 acts as a puff detector, detecting a user puffing or sucking on the mouthpiece of the e-cigarette 10. The airflow sensor 24 can be any suitable sensor for detecting changes in airflow or air pressure such a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 400 extending in an aerosol channel 32. The coil 28 may be positioned anywhere in the atomizer and may be transverse or parallel to the liquid supply. The atomizer may alternatively use other forms of heating elements, such as ceramic heaters, or fiber or mesh material heaters. Nonresistance heating elements such as sonic, piezo and jet spray may also be used in the atomizer in place of the heating coil.

A liquid supply 34 containing a reservoir supplies liquid to the wick 400. The wick 400 may be a porous material such as a bundle of fiberglass fibers, with liquid in the liquid supply 34 drawn by capillary action from the ends of the wick 400 towards the central portion of the wick 400 encircled by the heating coil 28. An air inhalation port 36 is provided at the back end of the atomizer/liquid supply section 14 remote from the end cap 16. The inhalation port 36 may be formed from the cylindrical hollow tube atomizer/liquid supply section 14 or may be formed in an end cap.

In use, a user sucks on the e-cigarette 10. This causes air to be drawn into the e-cigarette 10 via one or more air inlets, such as inlets 38 and to be drawn through the aerosol channel 32 towards the air inhalation port 36. The change in air pressure is detected by the airflow sensor 24 which generates an electrical signal that is passed to the control electronics 22. In response to the signal, the control electronics 22 activates the heating coil 28 which causes liquid present in the wick 400 to be vaporized creating an aerosol (which may comprise gaseous and liquid components) within the central passage 32. As the user continues to suck on the e-cigarette 10, this aerosol is drawn through the passageway 32 and inhaled by the user. At the same time the control electronics 22 also activates the LED 20 causing the LED 20 to light up which is visible via the translucent end cap 16 simulating the appearance of a glowing ember at the end of a conventional cigarette. As liquid present in the wick 400 is converted into an aerosol more liquid is drawn into the wick 400 from the liquid supply 34 by pressure forces, capillary action or pumping, and thus is available to be converted into an aerosol through subsequent activation of the heating coil 28.

Some e-cigarettes are intended to be disposable and the electric power in the battery 18 is intended to be sufficient to vaporize the liquid contained within the liquid supply 34 after which the e-cigarette 10 is thrown away. In other embodiments the battery 18 is rechargeable and the liquid supply is refillable. In the cases where the liquid supply 34 is a toroidal cavity, this may be achieved by refilling the liquid supply via a refill port. In other embodiments the atomizer/liquid supply section 14 of the e-cigarette 10 is detachable from the battery section 12 and a new atomizer/liquid supply section 14 can be fitted with a new liquid supply 34 thereby replenishing the supply of liquid. In some cases, replacing the liquid supply 34 may involve replacement of the heating coil 28 and the wick 400 along with the replacement of the liquid supply 34.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

FIGS. 1A-1D are sectional views of a liquid supply having a housing 100 and a reservoir 200 having a main body 202 for storing liquid. The reservoir 200 is fitted within the housing, with a gasket 300 at an outlet port 201 of the reservoir. The housing 100 has a reservoir space or compartment 102 enclosed by inner walls 101, with a vent hole 104 through the housing 100 and leading into the compartment 102. The housing 100 may be cylindrical. The reservoir 200 may be made from elastomeric material, such as natural or synthetic rubber and is positioned within the compartment 102. The outlet port 201 of the reservoir 200 is provided for filling liquid and allowing liquid to be dispensed. The housing 100 may be provided with an atomizer 26, so as to be used in place of the atomizer/liquid supply section 34 shown in FIG. 8.

In FIG. 1C, the opening 103 of the compartment 102 and the outlet port 201 of the reservoir 200 are securely connected by screw threads or other attachment features such as a snap or twist fitting, adhesives, etc. As shown in FIG. 1D, the opening 103 of the compartment 102 can be gradually narrowed, for example via a tapered inner wall. The outlet port 201 is provided in a gradually narrowed contour to track the contour of the opening 103 so that the opening 103 and the outlet port 201 can be more securely connected. The liquid guiding gasket 300 is made from a porous material, such as fibers, fiber felt, or braided fibers for conducting liquid from the reservoir via the outlet port 201 to the atomizer of the electronic cigarette. The fiber can be carbon fiber, glass fiber, or mixed braided carbon fiber and glass fiber.

In the embodiments shown in FIGS. 1A-1D, the main body 202 of the reservoir 200 is made from elastomeric material. This allows a pre-tension to be applied on the main body 202 to facilitate outflow of liquid. The elastomeric material may be stretched as the reservoir is filled with liquid, with elastic forces maintaining the liquid under pressure in the reservoir. A valve may be provided at the outlet port 201. When the valve is opened, liquid flows out through the outlet 201. Alternatively, the outlet port 201 may be left permanently open, and the reservoir provided with a low pre-tension, just sufficient to continuously supply liquid to the atomizer.

As shown in FIGS. 1C and 1D, a reservoir fully filled with liquid can substantially occupy the entire volume of the compartment. As liquid is consumed, the reservoir contracts. The contraction of the main body 202 can be more sensitive to the sub-atmospheric pressure generated at the gasket 300 or the outlet port 201 when pre-tension is applied.

Figure 2C:
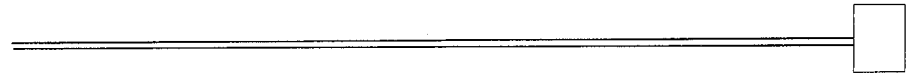
FIGS. 2A-2C are side views of a reservoir fully filled, partially contracted and a fully contracted.
Figure 2B:
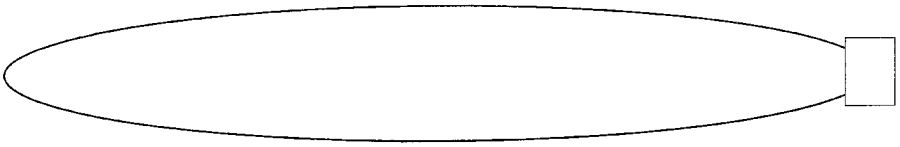
Figure 2A:
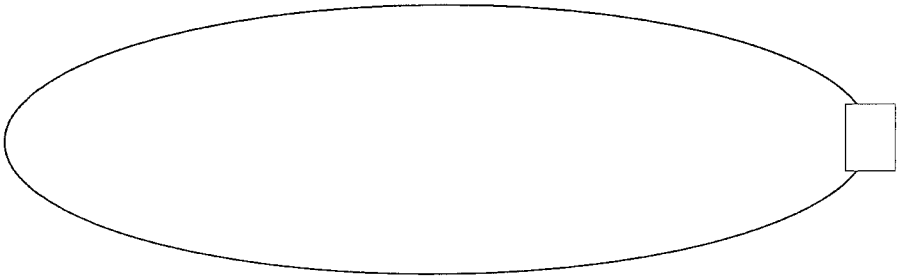

The main body 202 can be shaped as a pillow as shown in FIGS. 2A-2C. That is, the main body may be rectangular or cylindrical, with flat or curved ends. The main body 202 can be made by bonding or welding two sheets of elastomeric material such as rubber or non-elastomeric material. FIGS. 2A-2C illustrate a fully filled reservoir, a partially contracted reservoir and a fully contracted reservoir. As shown in FIG. 2C, when fully contracted, the main body 202 of the reservoir contracts to its minimum size, which may be as thin as the thickness of the two sheets of material.

As shown in FIG. 10, the bottom 223 of the main body 202 can be attached to an end wall 101A of the housing opposite from the opening via a rigid connector 500A. During contraction of the main body 202, the anchored or connected bottom 223 prevents the main body 202 from collapsing or folding, so that flow of liquid out of the reservoir is not restricted.

Figure 3A:
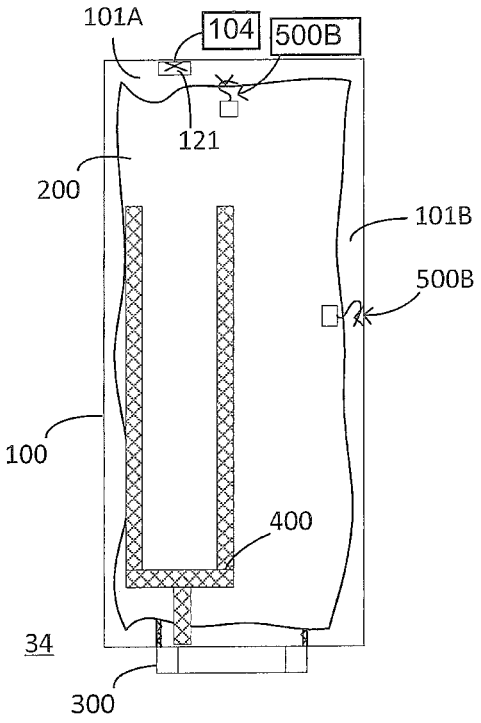
FIG. 3A is a section view of a reservoir according to another embodiment.
Figure 3B:
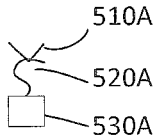
FIG. 3B is an enlarged view of the elastic connection shown in FIG. 3A.

As shown in FIGS. 3A and 3B, the bottom 223 of the main body can also be elastically connected to the end wall 101A of the housing via an elastic connector 500B. The elastic connector allows for moderate longitudinal movement of the reservoir within the compartment and reduces stress on the main body 202. The elastic connector 500B for example, may include a buckle 510A provided on the end wall, and a hook 520A connected to the bottom of the main body via a rubber band 530A, or vice versa.

As shown in FIG. 10, the main body 202 of the reservoir can additionally be fixedly connected or anchored to a side wall 101B of the housing through a rigid connection 500A. Similarly, as shown in FIG. 3A, the side wall of the main body can also be elastically connected to the side wall of the housing through an elastic connector 500B to reduce stress of the material that made the main body. The connectors 500A and 500B may optionally allow the reservoir to be removed from the housing, to allow for replacement or exchange of reservoirs, optionally containing different liquids.

In FIG. 3A, the vent hole 104 allows air to be drawn into the compartment 102 as the reservoir contracts. A valve 121, such as a check valve, can be provided within the vent hole 104. The valve 121 can prevent drawing excessive air into the compartment 102 before or during contraction of the reservoir which may apply undesired pressure onto the main body of the reservoir. Therefore, the pressure within the compartment 102 can be regulated at a desired value for a smooth out flow of the liquid.

Figure 4:
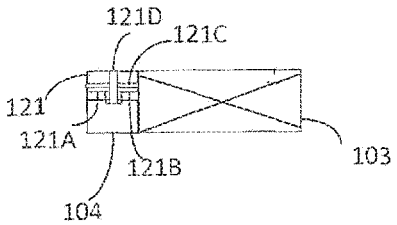
FIG. 4 is a side view of a ventilating hole and a valve positioned within the ventilating hole.

The vent hole 104 can be provided on the end wall, the side wall or even the opening 103 of the compartment 102. In FIG. 4, the vent hole is provided within the opening 103 of the housing 100. A section of the opening 103 acts as a valve seat having a front plate 121A having a plurality of orifices 121B. A diaphragm 121C is mounted within the valve seat via a pin 121D. The diaphragm can be made from flexible material such as natural or synthetic rubber, or from a rigid material such as plastic.

The diaphragm 121C is maintained at a closed positon when the pressure within the compartment is set at a desired initial value. During contraction of the main body, the diaphragm deforms in the case of a flexible material, or displaces in the case of a rigid material, when a predetermined sub-atmospheric pressure is generated within the compartment, to allow air to be drawn through the orifices into the compartment. The diagram 121C returns to its closed initial position when the pressure within the compartment returns to nominal. A spring loaded sealing member can also be used within the valve seat to function as a check valve for regulating the pressure within the compartment and therefore achieve a pre-tensioned reservoir.

Figure 5A:
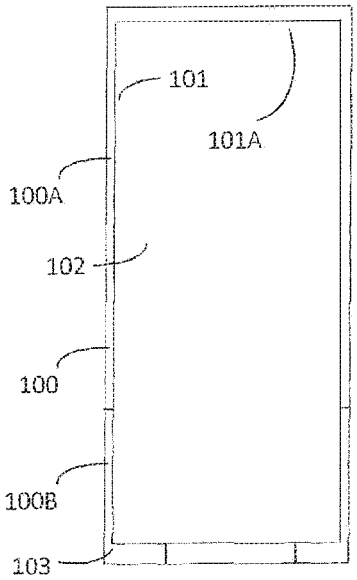
FIGS. 5A and 5B are side views of a housing for a liquid supply.
Figure 5B:
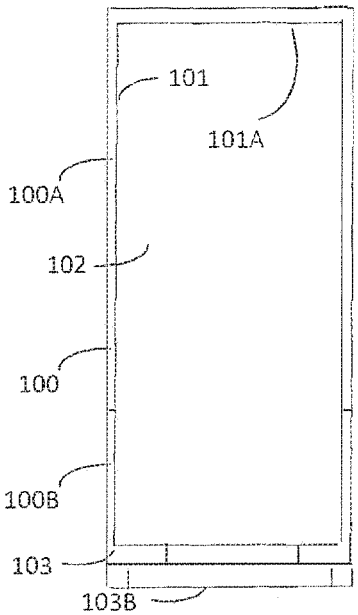

The housing 100 can be a two-piece design, for example, as shown in FIG. 5A. The housing 100 can have a first piece 100A that accommodates the main body of the reservoir and a second piece 100B for accommodating the outlet port of the reservoir, with the housing made from rigid material. As shown in FIG. 5B, the second piece of the housing can also have a holder 103B for fitting in the liquid guiding gasket. The housing 100 may be cylindrical, or another shape, such as cubic, conical, trapezoidal or other regular or irregular shape, with the reservoir optionally having a matching shape. The housing may be provided as a cartridge or cartomizer, with screw threads, lugs, etc. for attaching the housing to another e-cigarette component, such as a battery housing.

As shown in FIG. 3A, a wick 400 may be provided within the reservoir 200 to assist in conveying liquid out to the liquid guiding gasket 300. If used, one end of the wick 400 extends through the outlet port of the reservoir into the main body, while the other end of the wick is in contact with liquid guiding gasket. The end of the wick within the main body can be divided into two, three, four or more sections, to maximize surface contact with the liquid. The end of the wick within the main body can extend to the longitudinal maximum length of the main body to provide maximized contacting area. The wick can be made from porous material, fibers, braided fibers, or fiber felt. The fiber used can be carbon fiber, glass fiber, or mixed braided carbon and glass fibers.

Figure 6:
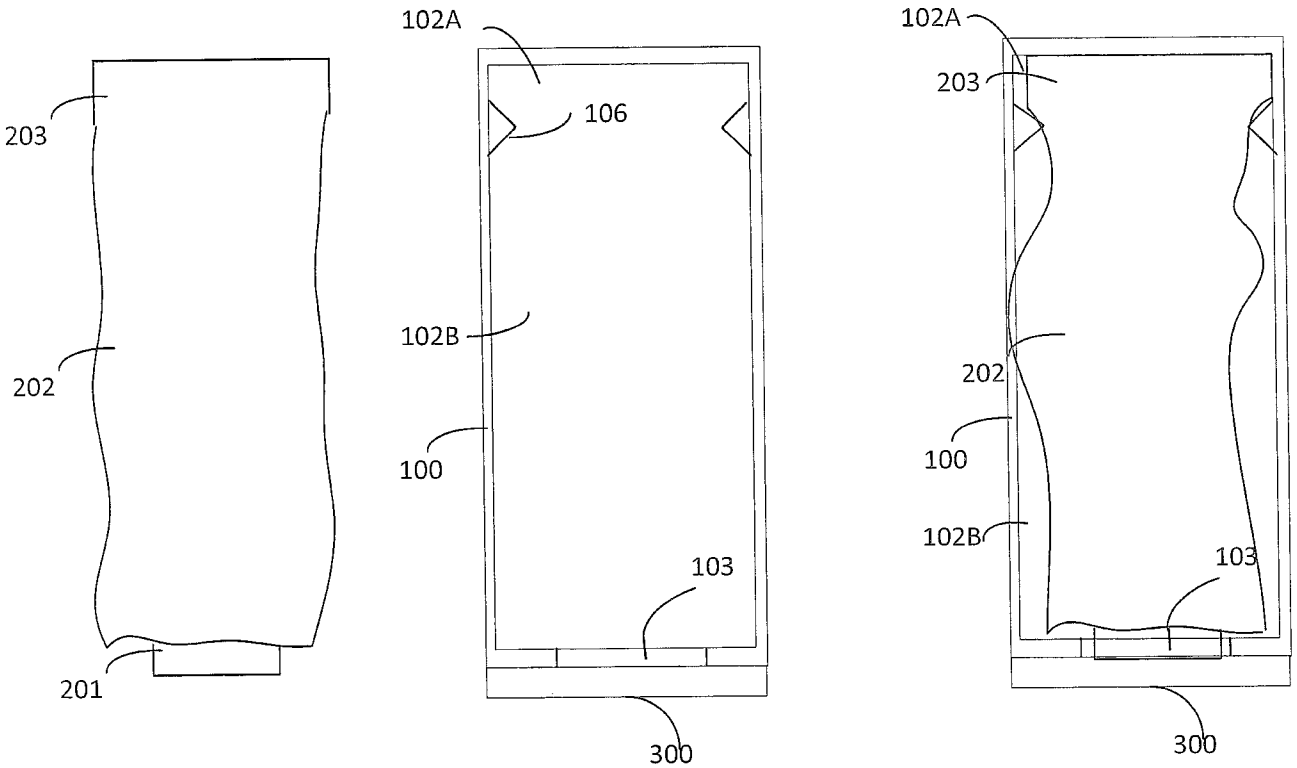
FIG. 6 shows another embodiment of an assembled liquid supply.

In FIG. 6, the reservoir 200 has an outlet port 201, a main body 202 and a rigid bottom 203. The housing 100 has protrusions or a bulge 106 on its inner surface so that the compartment within the housing is segmented into a first section 102A and a second section 102B. The first second 102A is configured to accommodate the rigid bottom portion 203 of the reservoir so that longitudinal movement and lateral movement of the rigid bottom portion is constrained with the first section of the compartment 102A. The first compartment 102A may be designed to have a dimension adapted to fit the bottom portion of the main body so that the bottom portion is substantially fixed within the first compartment.

Similar to FIGS. 1A-1D and 2A-2C, the side of the main body can be fixedly attached, anchored, or elastically connected to the inner surface of the second section of the compartment. A vent hole can be provided within the opening of the housing to allow pressure regulation within the compartment. A liquid guiding pad can be used instead of a gasket, with the pad in contact with the outlet port of the reservoir and/or the wick. The liquid guiding pad can have a laminated structure.

In some electronic cigarette designs, an aerosol channel can be provided along the perimeter of the housing to allow aerosol generated on a first side of the liquid supply to be delivered to a second side of the liquid supply which is opposite to the first side. In other electronic cigarette designs, the liquid supply does not contain an aerosol channel when the aerosol outlet and the atomizer are arranged on a same side of the liquid supply.

Figure 7:
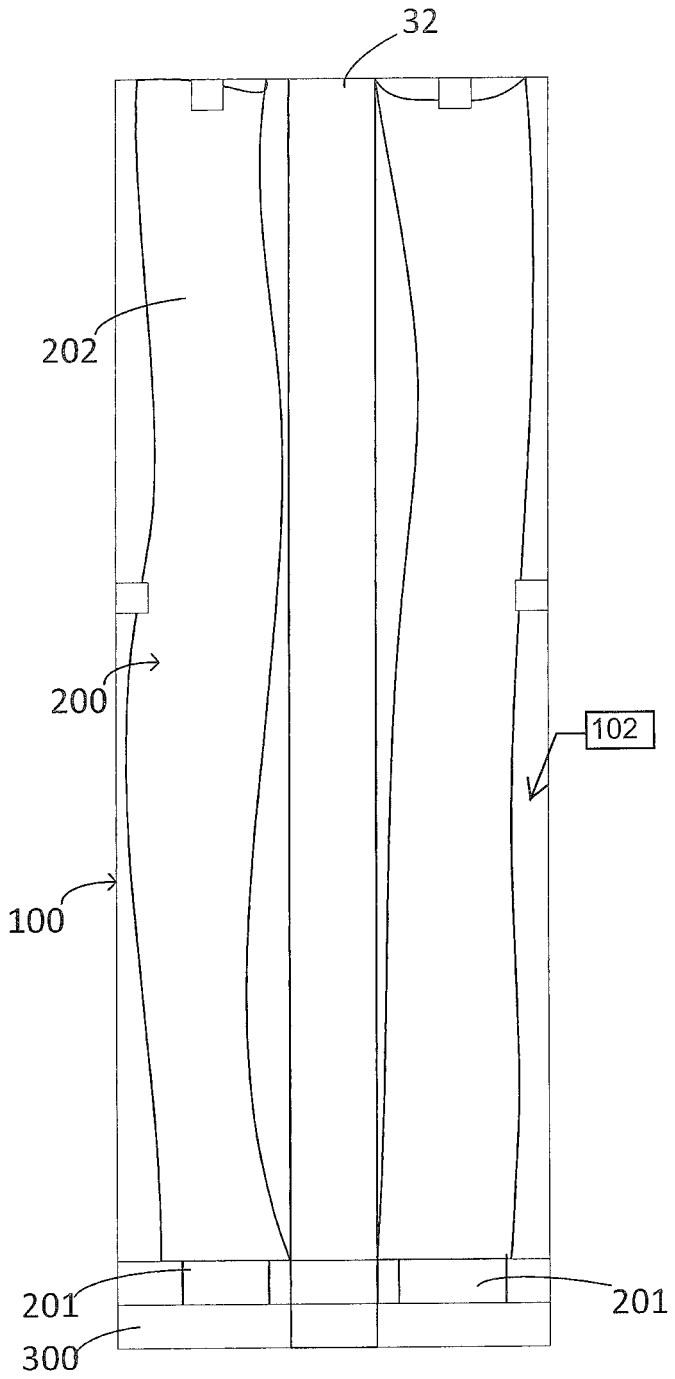
FIG. 7 shows a liquid supply having an toroidal space for holding a reservoir and having a central aerosol channel.

In FIG. 7, the liquid supply has a central aerosol channel 32 that is parallel to the longitudinal axis of the housing 100. In this embodiment, the inner surface of the housing forms a toroidal compartment 102. A reservoir 200 is positioned within the toroidal compartment 102 and is wrapped around the aerosol channel 32. The bottom of the main body 202 is fixedly connected to the bottom of the housing via rigid connection or elastic connections, and the side of the main body is optionally connected to the side wall of the housing via rigid or elastic connections. The main body 202 can have more than one outlet port 201, in this case, two outlet ports, to dispense liquid to the liquid guiding component 300.

From the foregoing, it will be appreciated that specific embodiments of the invention have been described herein for purposes of illustration, but that various modifications may be made without deviating from the spirit and scope of the invention. Accordingly, the invention is not limited except as by the appended claims and their equivalents.

The invention claimed is:

1. A liquid supply for electronic smoking device, comprising, a rigid liquid supply housing having a compartment; and a reservoir enclosed entirely within the compartment in the rigid liquid supply housing, with at least one portion of the reservoir attached to the rigid liquid supply housing;

the reservoir having a volume which changes with an amount of liquid in the reservoir;

the reservoir attached to one or more compartment walls for maintaining its longitudinal position within the compartment as liquid is removed from the reservoir; and wherein the reservoir comprises an elastomeric material.

2. The liquid supply of claim 1 wherein the reservoir has an outlet port constrained within a radially narrowing opening in the rigid liquid supply housing.

3. The liquid supply of claim 1 wherein the reservoir has a rigid bottom secured by protrusions in the rigid liquid supply housing, to restrict longitudinal movement of the rigid bottom within the rigid liquid supply housing.

4. The liquid supply of claim 1 wherein the reservoir has an outlet port, and further comprises a wick having two ends, with one end of the wick extending into the reservoir and the other end fixedly attached to an outlet of the reservoir.

5. The liquid supply of claim 4 wherein the wick extends from the outlet towards the bottom of the reservoir.

6. The liquid supply of claim 5 wherein the wick is bonded to the reservoir.

7. The liquid supply of claim 1 wherein the rigid liquid supply housing comprises a first piece and a second piece wherein the first piece is detachably connected to the second piece, an outlet port of the reservoir is positioned in the first piece and at least the bottom of the reservoir is anchored to the second piece.

8. The liquid supply of claim 7 wherein the volume of the first piece is greater than the volume of the second piece.

9. The liquid supply of claim 1 wherein sides of the reservoir are attached to the rigid liquid supply housing.

10. The liquid supply of claim 1 with the rigid liquid supply housing further comprising a vent hole leading into the compartment; and a valve positioned within the vent hole to regulate pressure within the compartment.

11. The liquid supply of claim 1 with the rigid liquid supply housing comprising a cartridge configured to be attached to a battery housing containing a battery, to form an electronic cigarette.

12. A liquid supply for electronic smoking device, comprising, a flexible reservoir entirely enclosed within a rigid liquid supply housing, the rigid liquid supply housing adapted to attach to a battery section containing a battery, the reservoir containing a liquid;

a first end of the flexible reservoir having an outlet port attached to the rigid liquid supply housing;

a liquid conducting component engaging the outlet port;

the flexible reservoir comprising an elastomeric or plastic polymer material, the flexible reservoir having no air inlet or vent;

a second end of the flexible reservoir attached to an end wall of the liquid supply housing by a flexible connector;

the flexible reservoir having a volume which changes with the amount of liquid in the flexible reservoir, and, the flexible reservoir maintaining longitudinal position within the liquid supply housing as liquid is removed from the flexible reservoir.

13. The liquid supply of claim 12 wherein the flexible reservoir is pillow-shaped and comprises sheets of the material joined together.

14. The liquid supply of claim 12 wherein the reservoir comprises an elastomeric material, and the reservoir is elastically stretched and pre-tensioned by filling the reservoir with liquid, with the reservoir exerting elastic compression force on the liquid in the reservoir.

15. A liquid supply for electronic smoking device, comprising, an elastomeric reservoir enclosed entirely within a rigid housing, the elastomeric reservoir containing a liquid;

a first portion of the elastomeric reservoir having an outlet port attached to the rigid housing;

a second and rigid portion of the elastomeric reservoir attached to an inside surface of the housing;

a liquid conducting component engaging the outlet port;

wherein the elastomeric reservoir is pre-tensioned by filling the elastomeric reservoir with liquid under pressure, with the elastomeric reservoir exerting elastic compression force on the liquid in the elastomeric reservoir; and the elastomeric reservoir maintaining longitudinal position within the compartment as liquid is removed from the reservoir.

16. The liquid supply of claim 15 with the liquid supply housing comprising a cartridge configured to be attached to a battery housing containing a battery, to form an electronic cigarette.

* * * * *